US010244848B1

(12) United States Patent
Javaherian

(10) Patent No.: US 10,244,848 B1
(45) Date of Patent: Apr. 2, 2019

(54) GROOMING MIRROR

(71) Applicant: Payam John Javaherian, Irvine, CA (US)

(72) Inventor: Payam John Javaherian, Irvine, CA (US)

( * ) Notice: Subject to any disclaimer, the term of this patent is extended or adjusted under 35 U.S.C. 154(b) by 0 days.

(21) Appl. No.: 15/969,668

(22) Filed: May 2, 2018

(51) Int. Cl.
*A45D 27/22* (2006.01)
*A45D 42/16* (2006.01)

(52) U.S. Cl.
CPC ..... *A45D 42/16* (2013.01); *A45D 2200/25* (2013.01)

(58) Field of Classification Search
CPC ..... A45D 27/29; A45D 42/00; A45D 42/08; A45D 42/14; A45D 42/16; A45D 44/08; A45D 44/16; A45D 44/14; A45D 2200/109; A45D 2200/25; B26B 19/44; B26B 19/3826; B26B 19/3806; B26B 19/48; A45B 2200/1009
See application file for complete search history.

(56) References Cited

U.S. PATENT DOCUMENTS 1,394,070 A * 10/1921 Diffany ..... F16M 11/00 248/113
1,902,211 A * 3/1933 Bjorklund ..... A45D 44/16 15/142
3,417,194 A * 12/1968 Meyer ..... A47L 7/0066 174/47
3,994,042 A * 11/1976 Zakis ..... B26B 19/38 15/312.1
4,689,830 A 9/1987 Williams
5,960,515 A 10/1999 Lu
6,382,802 B1 * 5/2002 Goodman ..... A45D 42/16 248/469
6,401,246 B1 * 6/2002 Perez ..... A45D 44/08 2/50
7,509,688 B2 3/2009 Gregg
2017/0013945 A1 1/2017 Galekovic

* cited by examiner

*Primary Examiner* — Rachel R Steitz
(74) *Attorney, Agent, or Firm* — Eric Karich; Karich & Associates

(57) ABSTRACT

A grooming mirror for assisting a user with clipping facial hair, so that hair clippings are captured for disposal without littering a bathroom area, has a reflective mirror mounted on a housing, and a base attached to and extending from the housing for operatively supporting the reflective mirror for use by the user. A clippings catching sheet is provided for catching the hair clippings. A rigid framework extends from the base to support the clippings catching sheet beneath the reflective mirror.

7 Claims, 3 Drawing Sheets

GROOMING MIRROR

BACKGROUND OF THE INVENTION

Field of the Invention

This invention relates generally to grooming supplies, and more particularly to a grooming mirror that includes a clippings catching sheet for catching hair clippings.

Description of Related Art

The prior art teaches various forms of capes and sheets that may be spread to catch hair clippings while grooming. For example, Williams, U.S. Pat. No. 4,689,803, teaches a hair cutting cape adapted to be worn by a person while receiving a haircut. The cape includes funnels for receiving the hair clippings, and preventing them from getting on the person, or falling onto the floor.

Another example is shown in Galekovic, U.S. 2017/0013945, which teaches a facial hair clippings catcher which is in the form of a sheet that is worn about the user's neck. The sheet includes a pair of suction cups so that the sheet may be fastened to a wall mirror for spreading the sheet beneath the user's face.

The prior art teaches a sheet that may be worn by a user for catching hair clippings. However, the prior art does not teach a grooming mirror that includes an expandable sheet for catching hair clippings. The present invention fulfills these needs and provides further advantages as described in the following summary.

SUMMARY OF THE INVENTION

The present invention teaches certain benefits in construction and use which give rise to the objectives described below.

The present invention provides a grooming mirror for assisting a user with clipping facial hair, so that hair clippings are captured for disposal without littering a bathroom area. The grooming mirror includes a reflective mirror mounted on a housing, and a base attached to and extending from the housing for operatively supporting the reflective mirror for use by the user. A clippings catching sheet is provided for catching the hair clippings. A rigid framework extends from the base to support the clippings catching sheet beneath the reflective mirror.

A primary objective of the present invention is to provide a grooming mirror having advantages not taught by the prior art.

Another objective is to provide a grooming mirror that includes a clippings catching sheet for catching hair clippings, to keep a bathroom area clean.

Another objective is to provide a grooming mirror that includes, in some embodiments, a vacuum system that enables the grooming mirror to be quickly and easily cleaned.

A further objective is to provide a grooming mirror that folds down so that it does not take up much counter space when not in use.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a grooming mirror for assisting a user with clipping facial hair, so that hair clippings are captured for disposal without littering a workspace, such as a counter-top in a bathroom area. While we discuss a counter-top in a bathroom area in the present embodiment, this terminology is hereby defined to include any other work-surface in any work-space that is desired by a user for grooming his or her face or body.

Figure 1:
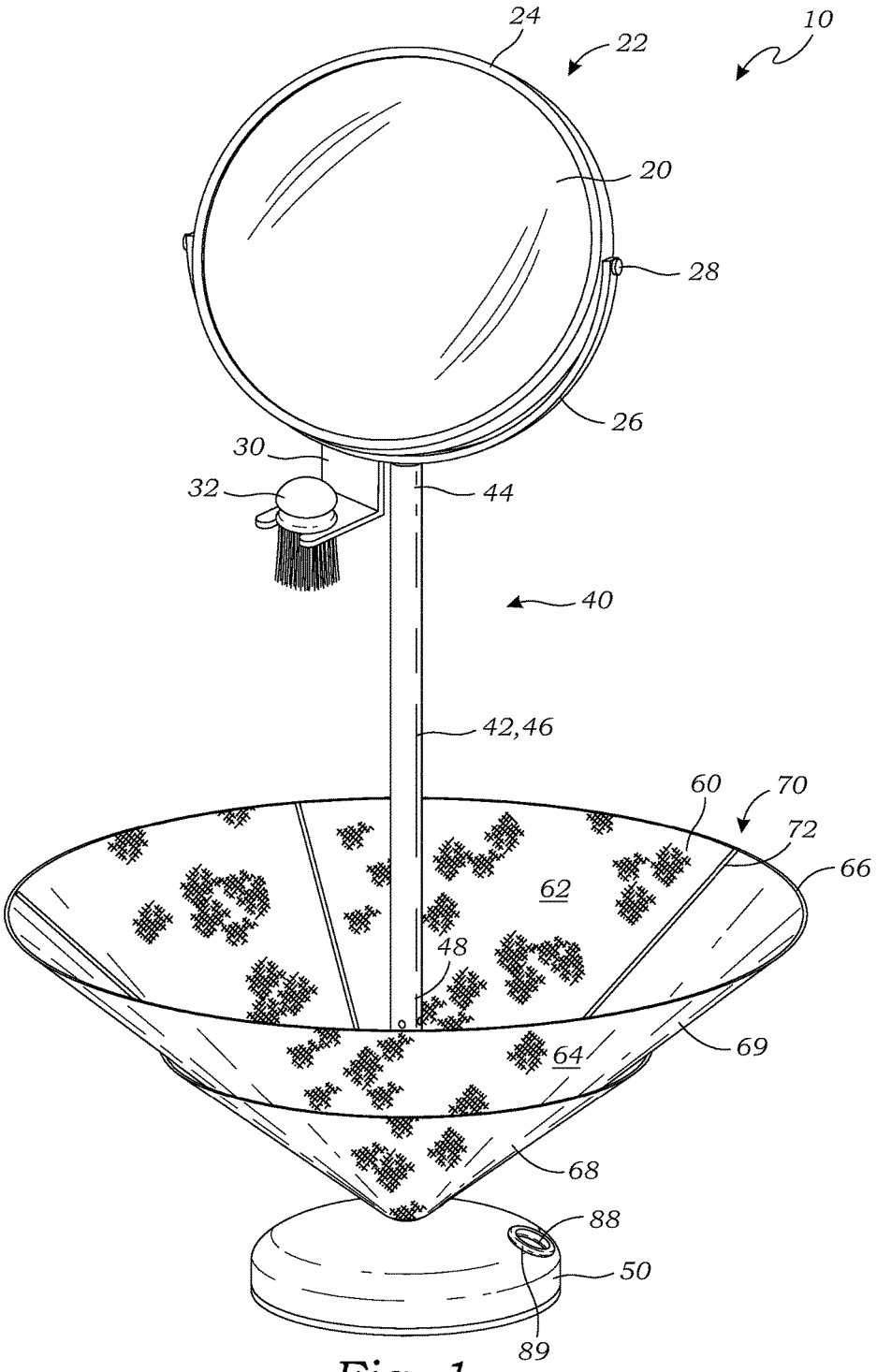
FIG. 1 is a perspective view of a grooming mirror according to one embodiment of the present invention, illustrating a clippings catching sheet in an extended configuration for use.

FIG. 1 is a perspective view of a grooming mirror 10 according to one embodiment of the present invention, illustrating a clippings catching sheet 60 in an extended configuration for use. As shown in FIG. 1, the grooming mirror 10 comprises a reflective mirror 20 mounted on a housing 22. In one embodiment, the reflective mirror 20 is a shaving mirror that is between 10-40 cm (typically about 30 cm). The reflective mirror 20 may be planar, or it may have an alternative shape, such as, for example, it may be shaped to magnify the objects seen in the mirror, to facilitate grooming.

The housing 22 may be any form of structure known in the art for mounting the mirror 20. In this embodiment, the housing 22 is a generally annular structure 24 that surrounds the reflective mirror 20. In this embodiment, the housing 22 may further include a pivot bracket 26 that extends beneath the annular structure of the housing 22, and is attached to the annular structure 24 via a pair of pivots 28, so that the reflective mirror 20 may be adjusted. The housing 22 may include lights (not shown) to illuminate the user while using the mirror. The housing 22 may further include one or more mounting structures 30 for holding a grooming accessory 32, such as a brush, scissors, clippers or clipper attachments, and/or other related accessories used in grooming.

As shown in FIG. 1, a base 40 is attached to and extends from the housing 22 for operatively supporting the reflective mirror 20 for use by the user. In this embodiment, the base 40 includes an elongate rigid base 42 having a top end 44, a middle portion 46, and a bottom end 48. The top end 44 is attached to the housing 22, in this case via the pivot bracket 26, although it could be attached to other locations, as desired by those skilled in the art. The bottom end 48 has a support base 50 for operatively supporting the reflective mirror 20 on a counter-top. The support base 50 may have a broader cross-section for providing stable support. Alternatively, the support base may include a fastening mechanism (not shown) for fastening the grooming mirror 10 to a counter-top, wall, or other surface or structure.

As shown in FIG. 1, the grooming mirror 10 further includes a clippings catching sheet 60 for catching the hair clippings. In this embodiment, the clippings catching sheet 60 is umbrella-shaped, having an inner surface 62 and an outer surface 64 that extend to an outer perimeter 66 that has, in this embodiment, a generally round shape. The clippings catching sheet 60 of this embodiment is constructed of a sheet of nylon, although alternative materials may be used (e.g., polyester, or other) if suitable for catching the hair clippings, as described herein. In this embodiment, the clippings catching sheet 60 has a radius of 20-40 cm, preferably about 32 cm, although alternative shapes and sizes may also be used, if desired by one skilled in the art.

In this embodiment, the clippings catching sheet 60 comprises an inner annular component 68 and an outer annular component 69 that are coaxially mounted around the base 40 and which overlap each other to form the overall structure. In alternative embodiments, a single sheet may be used, or many sheets, with any shape and configuration desired by one skilled in the art. While one embodiment of the clippings catching sheet 60 is shown, alternative shapes and constructions may also be devised by one skilled in the art, and these alternative shapes and constructions should be considered within the scope of the present invention.

As shown in FIG. 1, the mirror 20 functions to properly position the user (while he or she is using the mirror) so that his or her face is above the clippings catching sheet 60, so that the clippings catching sheet 60 functions to catch clippings generated from shaving, clipping, or otherwise grooming facial hair.

Figure 2:
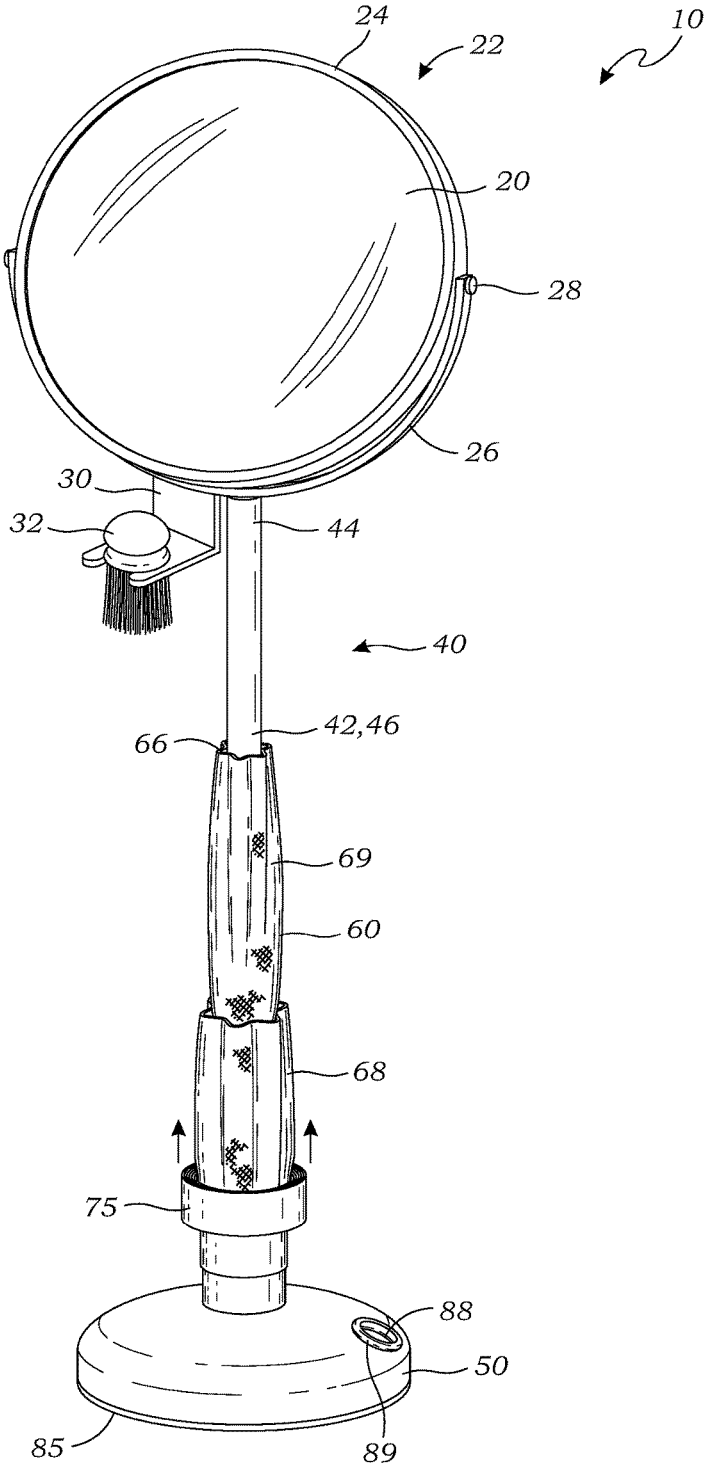
FIG. 2 is a perspective view of the grooming mirror, illustrating the clippings catching sheet in a retracted configuration.

FIG. 2 is a perspective view of the grooming mirror 10, illustrating the clippings catching sheet 60 in a retracted configuration. As shown in FIG. 2, the clippings catching sheet 60 if this embodiment is flexible, allowing the clippings catching sheet 60 to be readily retracted when not in use, so that it does not take up significant counter space while not in use.

As shown in FIGS. 1 and 2, the clippings catching sheet 60 is supported by a framework 70. In this embodiment, the framework includes a plurality of rigid spokes 72 that extend outwardly from the base 40 to support the clippings catching sheet 60 beneath the reflective mirror 20 for catching the hair clippings. In this embodiment, the rigid spokes 72 are each attached to the base 40 with a pivot 74 (shown in FIG. 3) so that the rigid spokes 72 together can pivot between an extended configuration, as shown in FIG. 1, wherein the rigid spokes 72 extend outwardly from the base 40, and a retracted configuration, as shown in FIG. 2, wherein the rigid spokes 72 collapse upwardly against the base 40.

While one embodiment of the framework 72 is illustrated in FIGS. 1 and 2, the framework 72 may be constructed of alternative structures (e.g., frame, substructure, scaffold, skeleton, support structure, etc.), and materials (e.g., metal, plastic, etc.), that function to extend the clippings catching sheet 60 as described herein, and such alternative embodiments should be considered within the scope of the present invention. While the framework 72 is pivotally connected in the present embodiment, it may alternatively be rigidly connected, or connected in an alternative manner, and these alternative structures should be considered within the scope of the present invention.

Figure 3:
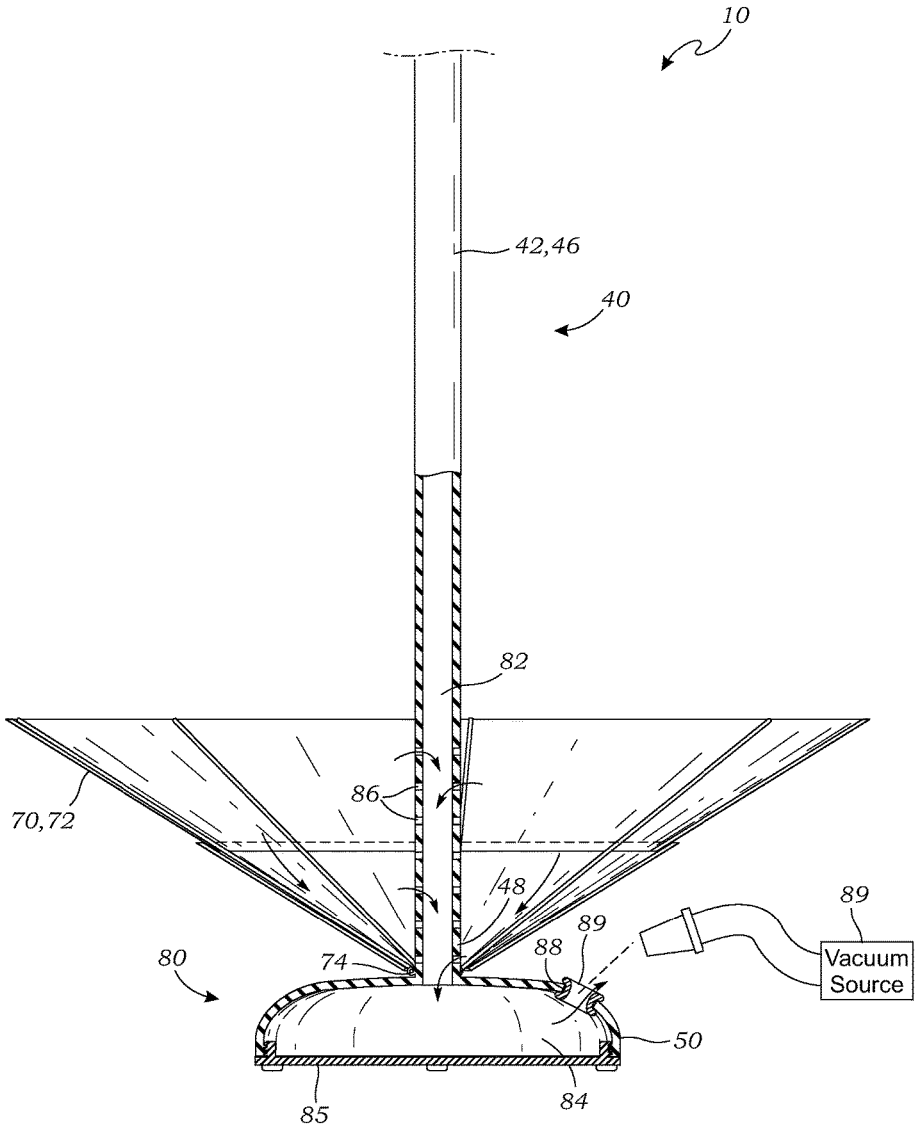
FIG. 3 is a front elevational view of the grooming mirror of FIG. 1, with a lower portion of the grooming mirror shown in cross-section to illustrate a vacuum system of the grooming mirror.

FIG. 3 is a front elevational view of the grooming mirror 10 of FIG. 1, with a lower portion of the grooming mirror 10 shown in cross-section to illustrate a vacuum system 80 of the grooming mirror 10. As shown in FIG. 3, in this embodiment the grooming mirror 10 further comprises a vacuum system 80 for cleaning the grooming mirror 10. In this embodiment, the vacuum system 80 comprises a hollow lower chamber 82 formed in the bottom end 48 of the elongate rigid base 42, which is in fluid communication with a hollow base chamber 84 of the support base 50. The hollow lower chamber 82 includes a plurality of intake holes 86 for allowing air and the hair clippings from the clippings catching sheet 60 to flow into the hollow lower chamber 82. The support base 50 may include an end cap 85 that engages the support base 50 (e.g., threadedly engages, frictionally engages, etc.) so that it may be unscrewed for cleaning.

As shown in FIGS. 1-3, the hollow base chamber 84 includes a vacuum port 88 for attaching a vacuum source 89 for drawing the air and the hair clippings from the hollow lower chamber 82, through the hollow base chamber 84, and out of the grooming mirror 10 for disposal. The vacuum port 88 may be in the form of a simple hole or slot, or in the form of a port, tube, or other mechanism which may be readily engaged with a vacuum source or other suitable device. In this embodiment, the vacuum port 88 includes an annular resilient seal 89 (e.g., silicone) for facilitating a frictional engagement with a range of sized conduits.

While one embodiment of the vacuum system is illustrated herein, alternative forms of the vacuum system 80 may be devised by those skilled in the art. For example, a vacuum source could be integrally installed in the base chamber, or in another convenient location. Other arrangements could also be devised, and such alternative structures should be considered within the scope of the present invention.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. A grooming mirror for assisting a user with clipping facial hair, so that hair clippings are captured for disposal without littering a bathroom area, the grooming mirror comprising:

a reflective mirror mounted on a housing;

a base attached to and extending from the housing for operatively supporting the reflective mirror for use by the user;

a clippings catching sheet for catching the hair clippings; and a rigid framework that extends from the base to support the clippings catching sheet beneath the reflective mirror, wherein the rigid framework includes a plurality of rigid spokes that extend outwardly from the base to support the clippings catching sheet beneath the reflective mirror for catching the hair clippings.

2. The grooming mirror of claim 1, wherein the base includes an elongate rigid base having a top end, a middle portion, and a bottom end, the top end being attached to the housing, the bottom end having a support base for operatively supporting the reflective mirror on a counter-top.

3. The grooming mirror of claim 1, wherein the clippings catching sheet is umbrella-shaped.

4. The grooming mirror of claim 1, wherein the rigid spokes are each attached to the base with a pivot so that the rigid spokes together can pivot between an extended configuration wherein the rigid spokes extend outwardly from the base, and a retracted configuration wherein the rigid spokes collapse upwardly against the base.

5. The grooming mirror of claim 1, wherein the clippings catching sheet comprises an inner annular component and an outer annular component that are coaxially mounted around the base and which overlap each other.

6. A grooming mirror for assisting a user with clipping facial hair, so that hair clippings are captured for disposal without littering a counter-top in a bathroom area, the grooming mirror comprising:

a reflective mirror mounted on a housing;

an elongate rigid base having a top end, a middle portion, and a bottom end, the top end being attached to the housing, the bottom end having a support base for operatively supporting the reflective mirror on the counter-top;

a clippings catching sheet for catching the hair clippings, the clippings catching sheet being umbrella-shaped; and a framework having a plurality of rigid spokes that extend outwardly from the support base or the elongate rigid base to support the clippings catching sheet beneath the reflective mirror for catching the hair clippings.

7. A grooming mirror for assisting a user with clipping facial hair, so that hair clippings are captured for disposal without littering a counter-top in a bathroom area, the grooming mirror comprising:

a reflective mirror mounted on a housing;

an elongate rigid base having a top end, a middle portion, and a bottom end, the top end being attached to the housing, the bottom end having a support base for operatively supporting the reflective mirror on the counter-top;

a clippings catching sheet for catching the hair clippings, the clippings catching sheet being umbrella-shaped;

a framework having a plurality of rigid spokes that extend outwardly from the support base or the elongate rigid base to support the clippings catching sheet beneath the reflective mirror for catching the hair clippings;

a vacuum system comprising a hollow lower chamber formed in the bottom end of the elongate rigid base, which is in fluid communication with a hollow base chamber of the support base, wherein the hollow lower chamber includes a plurality of intake holes for allowing air and the hair clippings from the clippings catching sheet to flow into the hollow lower chamber, and the hollow base chamber includes a vacuum port for attaching a vacuum source for drawing the air and the hair clippings from the hollow lower chamber, through the hollow base chamber, and out of the grooming mirror for disposal.

* * * * *